US010745653B2

(12) United States Patent
Meier et al.

(10) Patent No.: US 10,745,653 B2
(45) Date of Patent: Aug. 18, 2020

(54) DETERGENT PRODUCT

(71) Applicant: Henkel AG & Co. KGaA, Duesseldorf (DE)

(72) Inventors: Frank Meier, Duesseldorf (DE); Katja Gerhards, Duesseldorf (DE); Matthias Sunder, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 133 days.

(21) Appl. No.: 15/933,521

(22) Filed: Mar. 23, 2018

(65) Prior Publication Data

US 2018/0282671 A1 Oct. 4, 2018

(30) Foreign Application Priority Data

Mar. 31, 2017 (DE) ..... 10 2017 205 550

(51) Int. Cl.

| | |
|---|---|
| ***C11D 17/04*** | (2006.01) |
| ***B65D 65/46*** | (2006.01) |
| ***B65D 81/32*** | (2006.01) |
| ***B65D 75/32*** | (2006.01) |
| ***C11D 11/00*** | (2006.01) |

(52) U.S. Cl.

CPC ..... *C11D 17/042* (2013.01); *B65D 65/46* (2013.01); *B65D 75/324* (2013.01); *C11D 11/0017* (2013.01); *C11D 17/045* (2013.01); *B65D 81/3261* (2013.01)

(58) Field of Classification Search

None

See application file for complete search history.

(56) References Cited

U.S. PATENT DOCUMENTS

| | | | | |
|---|---|---|---|---|
| 2005/0115935 | A1* | 6/2005 | Edwards | B65B 61/06 219/121.67 |
| 2015/0267155 | A1* | 9/2015 | Brooker | C11D 17/045 8/137 |
| 2016/0068285 | A1 | 3/2016 | Fowler et al. | |
| 2016/0200501 | A1* | 7/2016 | Lee | B65D 85/808 |
| 2018/0057776 | A1* | 3/2018 | Brandt Sanz | B65B 9/023 |

FOREIGN PATENT DOCUMENTS

| | | | |
|---|---|---|---|
| DE | 102014102567 | A1 | 7/2015 |
| DE | 102014206095 | A1 | 10/2015 |
| EP | 2617659 | B1 | 4/2014 |
| EP | 3025969 | A1 | 6/2016 |
| EP | 3025983 | A1 * | 6/2016 |
| GB | 2374580 | A | 10/2002 |
| WO | 03062085 | A1 | 7/2003 |
| WO | 2004020288 | A1 | 3/2004 |

* cited by examiner

*Primary Examiner* — Lorna M Douyon

(74) *Attorney, Agent, or Firm* — Thomas G. Krivulka

(57) ABSTRACT

A detergent product for treating textiles, in particular for cleaning textiles and/or washing textiles, is illustrated and described, including a film pouch having at least one pouch chamber which is enclosed by at least one water-soluble film and contains a detergent preparation. In order to improve the dissolution behavior of the detergent product, the film pouch has at least one through-flow opening arranged outside of the pouch chamber.

15 Claims, 3 Drawing Sheets

DETERGENT PRODUCT

FIELD OF THE INVENTION

The invention relates to a detergent product, in particular for treating textiles, more particularly for cleaning textiles and/or washing textiles, comprising a film pouch having at least one pouch chamber which is enclosed by at least one water-soluble film and contains a detergent preparation.

BACKGROUND OF THE INVENTION

Water-soluble detergent products in the form of a single-use portion pack for treating textiles are known. Such a portion pack is used only once for treating textiles, usually in a textile washing machine. The detergent product comprises a film pouch having one or more pouch chambers. There may be accommodated in each pouch chamber a detergent preparation which contains for example active washing substances for treating textiles, in particular for washing textiles. The use of multiple pouch chambers opens up the possibility of separately holding different detergent preparations which under some circumstances chemically react with one another or are not storage-stable for other reasons when mixed together. In addition, the use of multiple different detergent preparations within one wash cycle permits the release of multiple, functionally different washing substances and/or additive substances, such as for example bleaches, fabric softeners or fragrances. If multiple pouch chambers are provided, the individual detergent preparations within the pouch chambers may have an identical or different consistency and are preferably of liquid consistency, for example liquid, gel-like or pasty, or of solid consistency, for example in powder, granule, free-flowing or solid form.

Once the detergent products in question have been added to water, the film dissolves and releases the detergent preparation. The film pouch may be formed of a plurality of water-soluble films, the water-soluble film preferably being PVA film (polyvinyl alcohol film). The films that can be used usually consist of polyvinyl alcohol copolymers with suitable additives such as plasticizers, surfactants, bittering agents or salts. The film pouch may be manufactured from a water-soluble base film and a water-soluble cover film, which form the boundary walls of at least one pouch chamber. The base film may for example be deep-drawn in a plastically deforming manner in order to form at least one pouch chamber. The base film and the cover film are then sealed to one another or connected to one another in one or more sealing or connecting sections. The sealing sections or sealing seams are then located in a so-called sealing plane or connecting plane of the two films.

Detergent products having multiple pouch chambers are known for example from DE 10 2014 102 567 A1. The detergent product described in the aforementioned document may comprise a plurality of chambers which may be arranged in a manner aligned above each other, that is to say positioned one above the other. To produce pouch chambers which are arranged one above the other, more than two film layers are sealed to one another. Also described are multi-chamber products in which the chambers are arranged alongside one another, that is to say positioned one next to the other. Chambers may also be arranged in such a way that a first chamber is located next to a second chamber, but the first chamber at least partially surrounds the second chamber but does not completely enclose the second chamber. Alternatively, one chamber may also be completely enclosed by another chamber. The chambers may be of different sizes and may each contain a laundry washing, textile care or dishwashing composition, including pretreatment or soaking compositions and other washing compositions. The composition may also be a detergent composition or a machine dishwashing composition. The detergent composition may be used during the main wash cycle or it may be used as a pretreatment or soaking composition.

A detergent product comprising a water-soluble pouch which has a plurality of pouch chambers arranged next to one another is known for example from EP 2 617 659 B 1. Two separate chambers are each filled with a cleaning agent, wherein the film pouch is manufactured from a water-soluble base film and a water-soluble cover film which are sealingly connected to one another in a sealing plane. The pouch chambers are separated from one another by sealing sections located in the sealing plane. The base film is deep-drawn in a plastically deforming manner in order to form the pouch chambers. In the sealing plane, a first pouch chamber has a first footprint and a second pouch chamber has a second footprint. The respective footprint is delimited by the contour line of the respective pouch chamber in the sealing plane. The film pouch has a third footprint, wherein the first footprint of the first pouch chamber has a concave section on its side facing toward the second pouch chamber, and wherein the second footprint of the second pouch chamber has a convex section on its side facing toward the first pouch chamber. The convex section of the second pouch chamber extends into the concave section of the first pouch chamber. The second footprint of the second pouch chamber has at least one concave section to the side of its convex section, said concave section being adjacent to at least one convex section of the first footprint. This geometry is intended to achieve a certain intrinsic shape stability of the film pouch, so that the pouch chambers do not fold in and out relative to one another in the manner of a hinge when the film pouch is manually held. This is because any folding in and out of the pouch chambers will often be interpreted by users of the detergent products in question to be an indication of supposedly poor product quality.

Particularly in the case of detergent products which have a plurality of pouch chambers separated from one another by sealing sections, but also in the case of other detergent products of the type under discussion, more particularly in the case of detergent products having a large footprint of the film pouch, two disadvantageous effects can be observed upon use in textile washing machines. In washing machines designed as front loaders, the detergent product may be transported below the washing machine door during a wash cycle due to the circulating movement of the laundry and the flow conditions of the washing liquid in the washing drum, into the region of a rubber sleeve of the washing machine which is provided as a door seal, and may float onto the rubber sleeve or be entrained or conveyed there by the laundry. The detergent product may become deposited there and stick there, since the water-soluble film exhibits a certain degree of tackiness upon contact with water, or may become jammed and remain in this region for a relatively long period of time or even for the remaining duration of the wash cycle. The washing liquid then flows less intensively around the film pouch, and there is no mechanical contact with the laundry and the washing drum. Both of these have an adverse effect on the dissolution behavior of the film pouch in the washing machine, with the film pouch dissolving more slowly and less completely than intended. As a consequence, usually residues of the detergent product, in particular film residues, can be found on the door seal at the end of a cycle of the washing machine. This is perceived as a nuisance by users of such products and as an indication of supposedly poor product quality. Cleaning the door seal of adhering product residues leads to undesired additional effort when washing laundry. In addition, when removing the laundry from the washing drum, it may happen that the product residues are stripped from the door seal and then remain in the clean laundry.

In washing machines designed as front loaders or as top loaders, detergent products having multiple pouch chambers in particular often tend predominantly to float on the surface of the washing liquid in the washing drum. This also leads to reduced mechanical contact of the film pouch with the laundry and with the washing drum, which is associated with a poorer dissolution behavior of the film pouch. The disadvantages of the film pouch floating on the washing liquid include, in particular, a delayed release of the detergent preparation and an incomplete dissolution of the film pouch at the end of a cycle in the washing machine.

BRIEF SUMMARY OF THE INVENTION

Proceeding from the prior art described above, the problem addressed by the invention is that of providing a generic detergent product which enables improved use in textile washing machines, including in particular an improved dissolution behavior of the film pouch during the washing process. The detergent product according to the invention should be characterized in particular by a high rate of dissolution and a largely residue-free dissolution during a wash cycle. In addition, the detergent product should be able to be manufactured inexpensively and with low production complexity.

In order to solve the aforementioned problem, it is proposed in a detergent product of the type mentioned above that the film pouch has at least one through-flow opening for washing water, which is arranged outside of the pouch chamber and by which a flow through the sealed-together film layers is ensured, particularly when used for treating textiles in a textile washing machine. The flow of the washing liquid through the film pouch has an advantageous effect on the buoyancy and/or floating behavior and thus also on the dissolution behavior (duration, degree of dissolution) of the film pouch. In particular, due to the at least one through-flow opening, the film pouch does not float on the washing liquid for a prolonged period of time but rather remains in the laundry to a greater extent and is transported around by the latter and in particular does not float onto or is not conveyed onto the door seal of the washing machine below the washing machine door and immobilized thereon.

In the context of the invention, the term "detergent product" is to be understood in the broad sense and also includes in particular those products which are used for cleaning dishes in dishwashers. The term "detergent preparation" is thus likewise to be understood in the broad sense and also includes for example machine dishwashing detergents and rinse aids. The following observations relating to the use of the detergent product according to the invention in textile washing machines also apply accordingly to embodiments of the detergent product according to the invention for use in dishwashers, without this being discussed in detail.

The more intensive flow of the washing liquid around the film pouch, which can be attributed to the through-flow opening, and also the greater contact of the film pouch with the laundry and the washing drum in a manner that is sustained over the wash cycle result in a reduced dissolution time and a higher degree of dissolution of the film pouch when used in a washing machine. The through-flow opening first enables rapid wetting of the film pouch from both sides, especially since at times water runs into the washing machine from above, for example at the porthole in the door region, and in addition enables the creation of an advantageous, particularly turbulent flow profile in the vicinity of the pouch chambers. An intensive flow around the pouch film and thus also a high degree of dissolution can also be achieved in the region between adjacent pouch chambers.

In the context of the invention, a "through-flow opening" is to be understood to be an opening in the material of the film layers of the film pouch (outside of the pouch chambers), through which a sufficiently large flow of washing water can pass during a wash cycle so that the floating and/or dissolution behavior of the film pouch is measurably, and in particular visually perceptibly, improved. In other words, the through-flow opening leads to the situation whereby the film pouch does not merely float on the washing liquid during a wash cycle but rather is circulated with the washing liquid as intensively as possible and comes into intensive contact with the laundry. The through-flow of the washing liquid accelerates the dissolution of the film pouch and increases the degree of dissolution after a predefined washing duration.

Preferably, the pouch chamber is formed by at least two, preferably only two, film layers which are sealed to one another in one or more sealing sections, wherein the through-flow opening is arranged preferably in the region of a sealing section between two adjacent pouch chambers. Via the through-flow opening, there is an intensive flow through and around the region between two adjacent pouch chambers, which leads to an improved and more complete dissolution in this region, which would otherwise be exposed only to a rather poor flow.

Furthermore, the film pouch may preferably have a footprint located in the sealing plane or connecting plane of the films, and the through-flow opening may be provided in a middle region of the footprint of the film pouch. Experiments carried out in the context of the invention have shown that particularly advantageous effects on the floating and dissolution behavior of the film pouch can be achieved in the case of a through-flow opening arranged in the middle region of the film pouch. In this connection, the film pouch may be manufactured from at least one water-soluble base film and at least one water-soluble cover film, which are sealingly connected to one another in the sealing plane, wherein the film pouch has a footprint in the sealing plane and the opening is provided in a middle region of the footprint at a distance from the outer edge of the film pouch and at a distance from the pouch chambers. The footprint of the film pouch is delimited by the contour line of the film pouch in the sealing plane. The footprint may preferably be circular or polygonal, in particular square or rectangular. It will be understood that the film pouch may in principle, however, also have a different contour shape in the sealing plane.

The film pouch may have between two to ten pouch chambers, preferably between three and five pouch chambers. At least one through-flow opening may be provided between at least two adjacent pouch chambers. In principle, it is also possible that, in the case of more than two pouch chambers, in each case at least one through-flow opening is arranged between each two pouch chambers. Depending on the geometry of the pouch chambers, more than two pouch chambers may also be arranged around one through-flow opening. This is the case in particular when the pouch chambers are arranged around a middle region of the film pouch. A central through-flow opening may then be provided in a middle sealing section of the film pouch, and is surrounded by a plurality of pouch chambers arranged next to one another.

Depending on the size of the through-flow opening, preferably just one through-flow opening may be provided in order to achieve the above-described advantageous effects on the floating behavior and the dissolution behavior of the film pouch. With just one through-flow opening arranged preferably centrally, a high intrinsic shape stability of the film pouch can be ensured, wherein in particular there is no fear of bending or folding of pouch chambers arranged adjacent to the opening on the film pouch.

However, a plurality of through-flow openings may also be provided, but preferably less than ten through-flow openings, more preferably less than 5 through-flow openings, for example two or three through-flow openings.

A high intrinsic shape stability of the detergent product according to the invention can be achieved by sealing seams running non-rectilinearly between the pouch chambers and the through-flow opening(s).

Preferably, all through-flow openings are of identical design, which simplifies production of the detergent product and ensures an even through-flow. However, it is not ruled out that at least two through-flow openings which have a different size and/or a different shape are provided, in particular between adjacent pouch chambers of different geometry. The shape and/or size of the through-flow openings may be adapted to the shape and/or size of the adjacent pouch chambers.

According to the invention, the shape and/or size of the through-flow opening(s) can be optimized with a view to an improved dissolution behavior and taking account of the highest possible intrinsic shape stability of the film pouch.

The through-flow opening may be oval, in particular circular or elliptical, or polygonal, in particular triangular or quadrangular, or may be boomerang-shaped or star-shaped. Circular contours can be made in the film material in an easy and inexpensive manner by punching. For non-circular contours, the laser cutting method is particularly suitable for producing the through-flow opening.

The shape of the through-flow opening may be adapted to the shape of at least one adjacent pouch chamber. The outer contour of the through-flow in the sealing plane may then run in a manner that is complementary, at least in some sections, to the outer contour of an adjacent pouch chamber. In the context of the invention, "complementary" means "running parallel" or having the same curvature. Preferably, the outer contour of the through-flow opening is adapted to the outer contours of all adjacent pouch chambers, wherein the through-flow opening may be at a distance from all pouch chambers that varies but is equal for all pouch chambers.

A sealing section is provided between the pouch chamber and the through-flow opening, wherein the sealing section may have a width between 1 to 5 mm, preferably between 2 and 3 mm. If the sealing section is made as narrow as possible, the user's attention is drawn to the pouch chambers and to the contents thereof. The user is then less aware of the sealing sections, which leads to a high degree of user acceptance of the detergent product according to the invention.

To achieve a high degree of shape stability of the detergent product, the sealing sections between the pouch chambers and the through-flow opening are preferably non-rectilinear.

To influence the dissolution behavior of the detergent product according to the invention in the washing machine and to achieve a high intrinsic shape stability, the opening area of the through-flow opening may be preferably between 10 $mm^2$ and 400 $mm^2$, more preferably between 15 $mm^2$ and 200 $mm^2$. If a plurality of through-flow openings are provided, the total opening area of all through-flow openings may correspondingly be between 10 $mm^2$ and 400 $mm^2$, preferably between 15 $mm^2$ and 200 $mm^2$.

The footprint of the film pouch, which is predefined by the outer contour line of the film pouch in the sealing plane, lies for example in the range between 2000 $mm^2$ to 5000 $mm^2$.

One highly preferred embodiment of the invention provides that the proportion of the opening area of the through-flow opening on the footprint of the film pouch is between 0.5% to 50%, preferably between 4% to 20%. If a plurality of through-flow openings are provided, the proportion of the total opening area of all through-flow openings on the footprint of the film pouch may correspondingly lie in the same range.

The method for producing the detergent product according to the invention and also the water-soluble films used for producing the product are generally known to a person skilled in the art. Examples of preferred polymers, copolymers or derivatives which are suitable for use as pouch chambers, as well as suitable detergent preparations, are described in DE 10 2014 102 567 A1. The content of the disclosure of the aforementioned document is hereby incorporated in the content of the disclosure of the description of the present invention.

BRIEF DESCRIPTION OF THE DRAWINGS

The invention will be explained in greater detail below by way of example and with reference to the figures. The features mentioned and described above and also the features shown in the drawing and described below can be combined as required, even if this is not shown and/or described in detail. The invention is not limited to the features and combinations of features shown in the figures. In the figures.

DETAILED DESCRIPTION OF THE INVENTION

Figure 1:
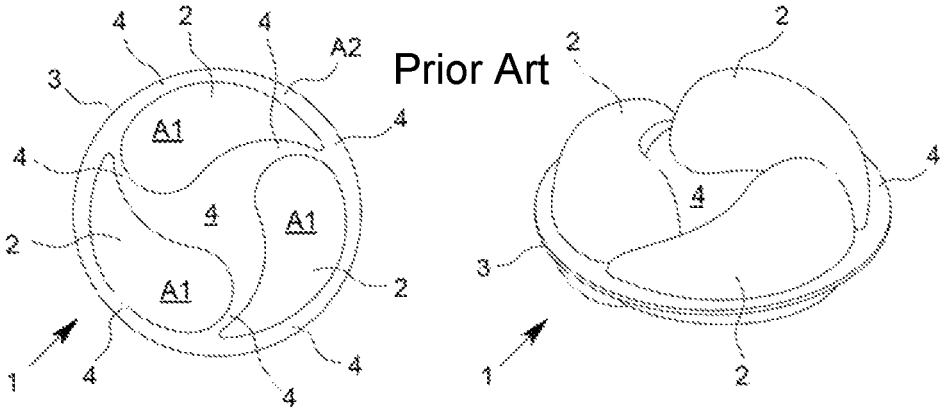
FIG. 1 shows a detergent product, not according to the invention, having three pouch chambers which are arranged around a closed central sealing section, in a view of the footprints of the pouch chambers from above and in a perspective view at an angle from above.
Figure 2:
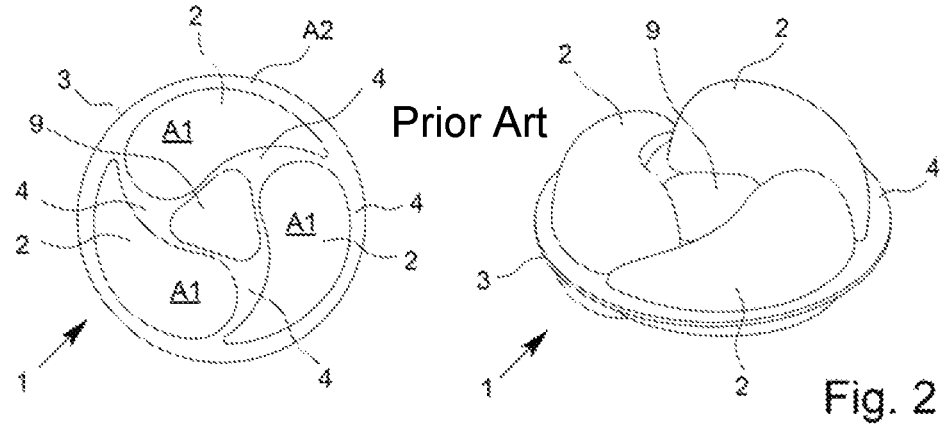
FIG. 2 shows a detergent product, not according to the invention, having three pouch chambers and one central chamber in the middle, in a view of the footprints of the pouch chambers from above and in a perspective view at an angle from above.
Figure 3:
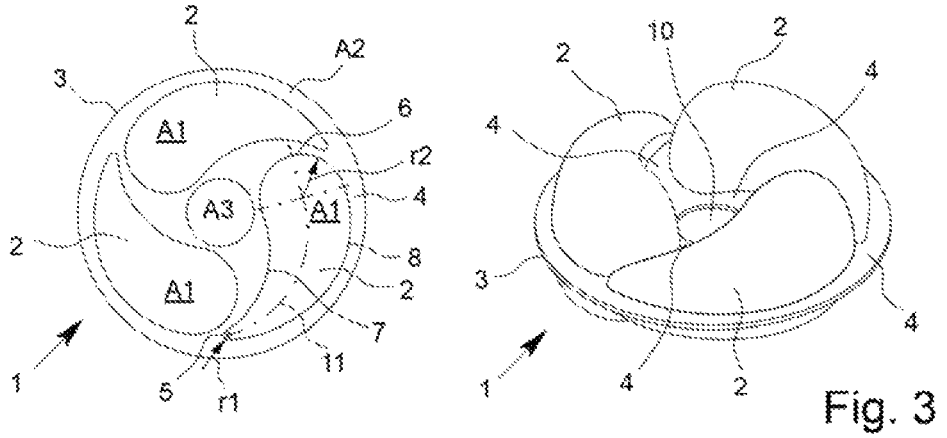
FIG. 3 shows a detergent product, according to the invention, having three pouch chambers and one central through-flow opening, in a view of the footprints of the pouch chambers from above and in a perspective view at an angle from above.

FIGS. 1 to 3 show a detergent product 1 having three pouch chambers 2 in the form of a single-use portion pack. The detergent product 1 is used only once for treating textiles, usually in a textile washing machine. The detergent product 1 comprises a film pouch 3 having the three pouch chambers 2. Accommodated in the individual pouch chambers 2 are detergent preparations which contain active washing substances for treating textiles, in particular for washing textiles.

Water-soluble films with the type designation M8630 or M8720 from the film manufacturer Monosol can be used to produce the film pouch 3. Alternatively, suitable water-soluble films from other film manufacturers, such as for example Aicello, Nippon Gohsei or Mondi, can also be used.

The film pouch 2 is formed of two water-soluble films, which may be in the form of PVA films. The water-soluble films enclose the pouch chambers 2 by forming the boundary walls thereof. During production, the films are connected to one another in the region of sealing sections 4 in such a way that the pouch chambers 2 are each sealed and separated from one another around their entire circumference by the sealing sections 4. Thus, between two adjacent pouch chambers 2, in each case a sealed film section is also provided, which connects the pouch chambers 2 to one another in order to achieve a single portion pack.

The pouch chambers 2 each have an identical footprint A1 in the sealing plane or connecting plane of the two films, while the total detergent product 1 or film pouch 3 has the footprint A2 in the sealing plane. The footprint A1 of the pouch chamber 2 is delimited by the contour line of the pouch chamber 2 in the sealing plane. The footprint A2 of the detergent product 1 is delimited by the contour line thereof in the sealing plane. In the embodiments shown, the footprint A2 of the detergent product 1 is circular. The footprint A2 could also have a contour line differing from a circular shape.

In all the embodiments shown in FIGS. 1 to 9, the footprints A1 of the pouch chambers 2 each have a droplet shape or teardrop shape which extends in each case from a narrow convex end section 6 of the contour of the respective pouch chamber 2 with a smaller inner radius r1 to a wider convex end section 6 with a larger inner diameter r2.

Provided between the two convex sections 5, 6 at the ends of the pouch chamber 2 is a concave connecting section 7 radially on the inside and a convex connecting section 8 radially on the outside.

Figure 6:
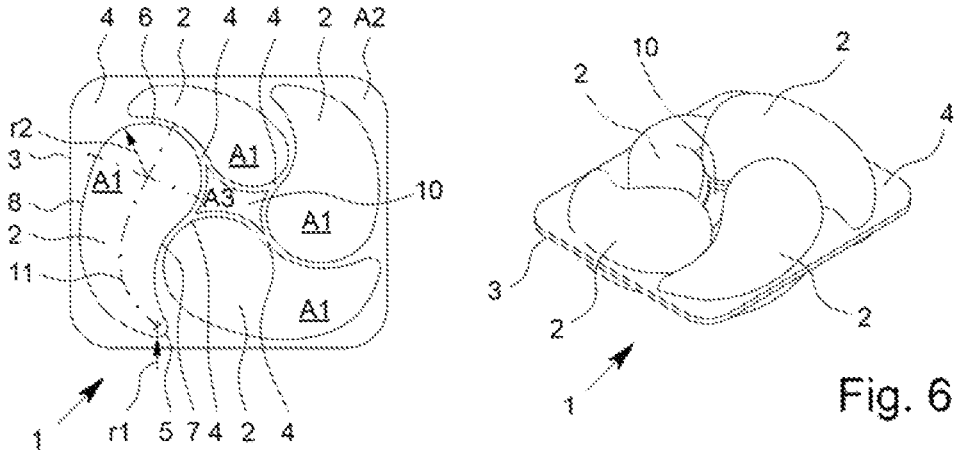
FIG. 6 shows a detergent product, according to the invention, having four pouch chambers and one central through-flow opening, in a view of the footprints of the pouch chambers from above and in a perspective view at an angle from above.
Figure 9:
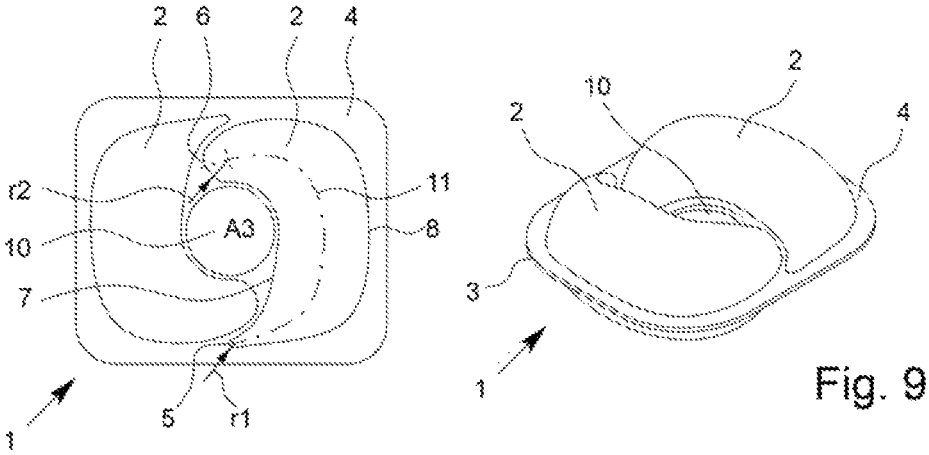
FIG. 9 shows a detergent product, according to the invention, having two pouch chambers and one central through-flow opening, in a view of the footprints of the pouch chambers from above and in a perspective view at an angle from above.

The area bisector 11 of the footprint A1 is shown by way of example for one pouch chamber 2 in FIGS. 3, 6 and 9. All the pouch chambers 2 of a film pouch 3 have the same direction of curvature of the area bisector 11. It will be understood that the pouch chambers 2 may also have differing chamber geometries.

The embodiments of detergent products 1 shown in FIGS. 1 to 3 differ only in respect of the design of the detergent product 1 in the middle region of the film pouch 3, wherein according to FIG. 1 a closed sealing section 4 is provided in the middle region of the film pouch 3. Said sealing section is surrounded toward the outside by the pouch chambers 2, wherein in each case a strip-shaped sealing section 4 remains between adjacent pouch chambers 2 so that the pouch chambers 2 are separated from one another and sealed toward the outside.

In the detergent product 1 shown in FIG. 2, a central chamber 9 is provided, the boundary walls of which are likewise formed by the water-soluble films of which the film pouch 3 is made. In the present case, the central chamber 9 has in the sealing plane a triangular contour line with rounded corner sections. The central chamber 9 may likewise contain a detergent preparation.

To improve the dissolution behavior, namely to reduce the time taken for the water-soluble films to (fully) dissolve and to increase the degree of dissolution with a view to a desired fullest possible dissolution of the water-soluble films, the embodiment shown in FIG. 3 has a circular through-opening 10 which is formed in the middle sealing section 4 between the radially outer pouch chambers 2 by punching or laser cutting. The through-flow opening 10 could also have a shape differing from the circular shape, for example may be shaped the same as the central chamber 9 in the sealing plane according to FIG. 2.

By virtue of the through-flow opening 10, washing water flows through the film pouch 3 during a wash cycle and in particular flows intensively around the inner region of the pouch chambers 3 adjacent to the through-flow opening 10. The intensive flow promotes dissolution of the water-soluble films particularly in the region of the inner walls of the pouch chambers 2, which face toward the middle region of the film pouch 3. In addition, the film pouch 3 cannot float in the washing water or cannot float therein for as long a period of time and does not predominantly become arranged in the region below a washing machine door and above a door seal during the cycle of the washing machine. The through-flow opening 10 ensures that the detergent product 1 is released quickly. The "empty" water-soluble pouch that initially still remains has a significantly reduced risk of being conveyed onto the rubber sleeve than the filled pouch. Instead, it is highly likely to remain in the water and will be circulated in the washing drum in contact with the laundry. This results in intensive (mechanical) contact of the film pouch 3 with the surrounding laundry and the surrounding washing drum, and thus in a faster and more complete dissolution of the films forming the film pouch 3.

The detergent products 1 shown in FIGS. 1 to 3 each have an identical size and shape of the footprints A1 of the pouch chambers 2 and of the total footprint A2 of the detergent product 1 in the sealing plane. The opening area A3 of the through-flow opening 10 is between 5% and 15%, preferably around 10%, in relation to the total footprint A2 of the film pouch 3.

Figure 4:
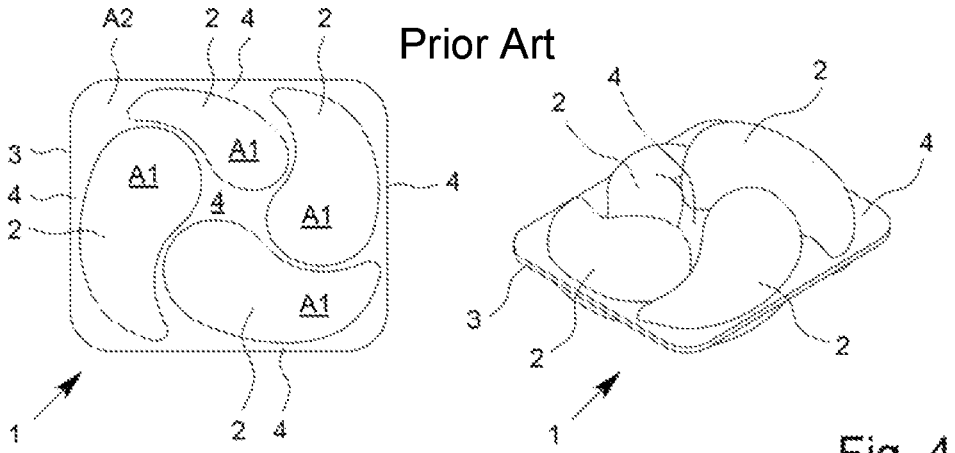
FIG. 4 shows a detergent product, not according to the invention, having four pouch chambers which are arranged around a closed central sealing section, in a view of the footprints of the pouch chambers from above and in a perspective view at an angle from above.
Figure 5:
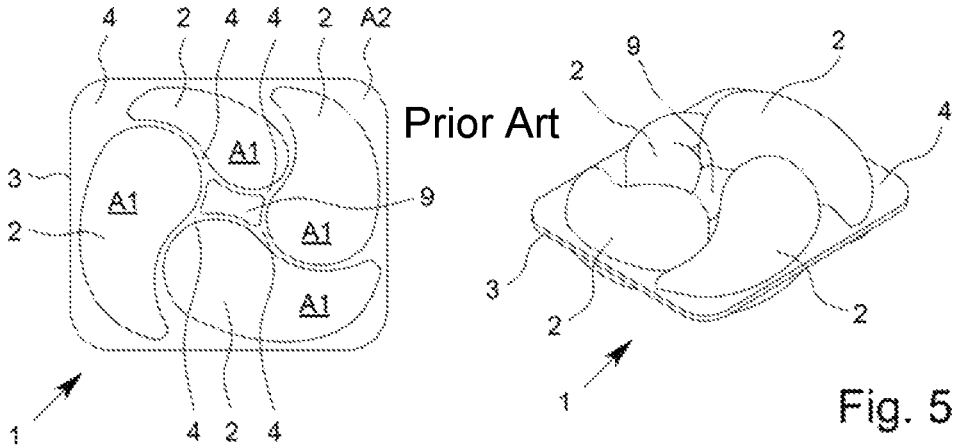
FIG. 5 shows a detergent product, not according to the invention, having four pouch chambers and one central chamber in the middle, in a view of the footprints of the pouch chambers from above and in a perspective view at an angle from above.

FIGS. 4 to 6 show embodiments of detergent products 1 which each have four outer pouch chambers 2. FIG. 4 shows an embodiment with a closed sealing section 4 in the middle region of the film pouch 3. FIG. 5 shows an embodiment with a central chamber 9 in the middle, and FIG. 6 shows an embodiment with a through-flow opening 10 arranged in the middle region of the film pouch 3 between the outer pouch chambers 2.

The contour line of the through-flow opening 10 is formed by four concave side sections which together form a rectangular or trapezoidal geometry. Each pouch chamber 2 is closed around its entire circumference by a closed sealing section 4 of the film pouch 3, wherein the width of the sealing sections 4 is selected in such a way that a minimal distance between the respective pouch chamber 2 and the through-flow opening 10 in the region of the sealing plane of preferably 1 mm to 5 mm is not exceeded. As a result, the user's attention is drawn to the interesting design of the pouch chambers 2 and to the contents thereof.

In addition, it can be seen from FIG. 6 that the outer contour of the through-flow opening 10 can run in a manner that, at least in some sections, is complementary, that is to say parallel, to the contours of the adjacent pouch chambers 2. The size of the through-flow opening 10 can thus be maximized and the width of the sealing sections 4 can be reduced as far as possible.

To achieve a high intrinsic stability of the film pouch 3, the sealing sections 4 are preferably non-rectilinear.

Figure 7:
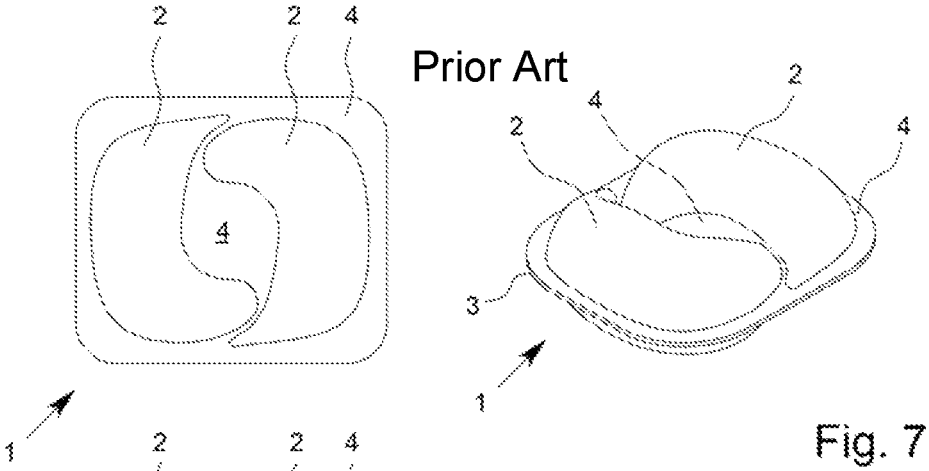
FIG. 7 shows a detergent product, not according to the invention, having two pouch chambers which are arranged around a closed central sealing section, in a view of the footprints of the pouch chambers from above and in a perspective view at an angle from above.
Figure 8:
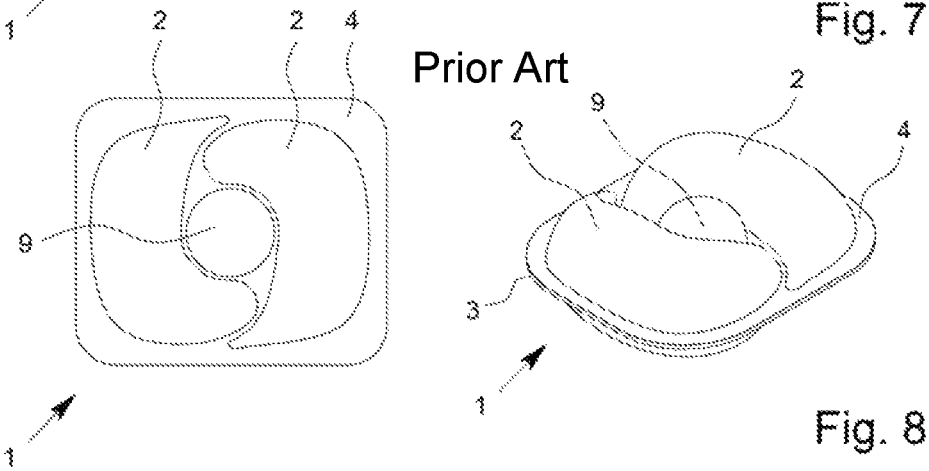
FIG. 8 shows a detergent product, not according to the invention, having two pouch chambers and one central chamber in the middle, in a view of the footprints of the pouch chambers from above and in a perspective view at an angle from above.

FIGS. 7 to 9 show further embodiments of detergent products 1 which comprise a film pouch 3 having in each case two pouch chambers 2. In FIG. 7, the two pouch chambers 2 surround a central closed sealing section 4. In FIG. 8, a spherical central chamber 9 is provided in the middle, and is surrounded by two pouch chambers 2. FIG. 9 shows a central through-flow opening 10 which is surrounded by two pouch chambers 2. One common feature of all the embodiments is that the pouch chambers 2 are of identical design.

To examine the effect of the through-flow opening 10 on the dissolution behavior of detergent products 1 of the illustrated type, in each case 20 automatic wash cycles were carried out using a commercially available textile washing machine from the company Bosch (front loader, type: WAS284DE—7 kg; quick wash program, "Cotton/speed perfect," 20° C.; 75% load=5.25 kg with a mixed batch of domestic laundry (towels, T-shirts, tea towels, pillowcase) 70% cotton-30% synthetic) using the detergent products 1 shown in FIGS. 1 to 9, and for each wash cycle carried out the dissolution behavior of the detergent product 1 used in each case was qualitatively (visually) assessed.

In each wash cycle, in each case one detergent product 1 was first placed into the washing drum of the washing machine and the washing machine was then loaded with standard laundry. The wash cycle was then started. During the wash cycle, the region in the washing machine below the washing machine door was observed through the door glass/porthole.

If the detergent product 1 was entrained by the laundry during the wash cycle and then floated onto a rubber sleeve (door seal) provided below the door of the washing machine, this was assessed as "Failure 1" of the detergent product 1.

If, after the end of the wash cycle, residues of the film pouch were found on the textile load, on the rubber seal (rubber sleeve) or in the washing drum, this was assessed as "Failure 2."

Based on the visual assessment, the following failure frequencies were determined for the detergent products 1 shown in FIGS. 1 to 9:

1. Detergent products having three pouch chambers (FIGS. 1 to 3):

| | Number of chambers: 3 (cf. FIGS. 1-3) | | | | | |
|---|---|---|---|---|---|---|
| | No opening (FIG. 1) | | Central chamber (FIG. 2) | | Central opening (FIG. 3) | |
| Wash cycle number | Failure 1 | Failure 2 | Failure 1 | Failure 2 | Failure 1 | Failure 2 |
| 1 | n | n | n | n | n | n |
| 2 | n | n | n | n | y | n |
| 3 | y | y | n | n | n | n |
| 4 | n | n | n | n | n | n |
| 5 | n | n | n | n | n | n |
| 6 | y | y | n | n | n | n |
| 7 | n | n | n | n | y | n |
| 8 | n | n | n | n | n | n |
| 9 | n | n | n | n | n | n |
| 10 | n | n | y | y | n | n |
| 11 | n | n | n | n | n | n |
| 12 | n | n | n | n | n | n |
| 13 | n | n | y | y | n | n |
| 14 | n | n | n | n | n | n |
| 15 | y | n | n | n | n | n |
| 16 | n | n | n | n | n | n |
| 17 | y | n | n | n | n | n |
| 18 | n | n | n | n | n | n |
| 19 | n | n | n | n | n | n |
| 20 | n | n | n | n | n | n |
| 21 | n | n | y | n | n | n |
| 22 | n | n | n | n | n | n |
| 23 | n | n | n | n | n | n |
| 24 | y | n | n | n | n | n |
| 25 | n | n | y | n | n | n |
| Total failure frequency in [%] | 5 + 2 = 7 28% | | 4 + 2 = 6 24% | | 2 + 0 = 2 8% | |

2. Detergent products having four pouch chambers (FIGS. 4 to 6)

| | Number of chambers: 4 (cf. FIGS. 4-6) | | | | | |
|---|---|---|---|---|---|---|
| | No opening (FIG. 4) | | Central chamber (FIG. 5) | | Central opening (FIG. 6) | |
| Wash cycle number | Failure 1 | Failure 2 | Failure 1 | Failure 2 | Failure 1 | Failure 2 |
| 1 | y | n | n | n | n | n |
| 2 | y | n | n | n | n | n |
| 3 | n | n | n | n | n | n |
| 4 | n | n | y | n | n | n |
| 5 | n | n | n | n | n | n |
| 6 | n | n | y | n | n | n |
| 7 | n | n | y | n | n | n |
| 8 | n | n | n | n | n | n |
| 9 | y | y | n | n | y | n |
| 10 | n | n | n | n | n | n |
| 11 | n | n | n | n | n | n |
| 12 | n | n | n | n | n | n |
| 13 | n | n | n | n | n | n |
| 14 | n | n | n | n | n | n |
| 15 | n | n | n | n | n | n |
| 16 | y | n | n | n | n | n |
| 17 | n | n | n | n | n | n |
| 18 | y | y | y | n | n | n |
| 19 | n | n | y | y | y | n |
| 20 | n | n | n | n | n | n |
| 21 | n | n | n | n | n | n |
| 22 | n | n | n | y | n | n |
| 23 | n | n | n | n | n | n |

-continued

| | Number of chambers: 4 (cf. FIGS. 4-6) | | | | | |
|---|---|---|---|---|---|---|
| | No opening (FIG. 4) | | Central chamber (FIG. 5) | | Central opening (FIG. 6) | |
| Wash cycle number | Failure 1 | Failure 2 | Failure 1 | Failure 2 | Failure 1 | Failure 2 |
| 24 | y | y | n | n | n | n |
| 25 | n | n | n | n | n | n |
| Total failure frequency in [%] | 6 + 3 = 9 36% | | 5 + 2 = 7 28% | | 2 + 0 = 2 8% | |

3. Detergent products having two pouch chambers (FIGS. 7 to 9)

| | Number of chambers: 2 (cf. FIGS. 7-9) | | | | | |
|---|---|---|---|---|---|---|
| | No opening (FIG. 7) | | Central chamber (FIG. 8) | | Central opening (FIG. 9) | |
| Wash cycle number | Failure 1 | Failure 2 | Failure 1 | Failure 2 | Failure 1 | Failure 2 |
| 1 | n | n | n | n | n | n |
| 2 | n | n | n | n | n | n |
| 3 | n | n | n | n | n | n |
| 4 | n | n | n | n | n | n |
| 5 | n | n | n | n | n | n |
| 6 | y | y | n | n | n | n |
| 7 | y | n | y | n | n | n |
| 8 | n | n | n | n | n | n |
| 9 | n | n | n | n | n | n |
| 10 | n | n | n | n | n | n |
| 11 | y | n | n | n | n | n |
| 12 | n | n | n | n | n | n |
| 13 | n | n | n | n | n | n |
| 14 | n | n | y | n | n | n |
| 15 | n | n | n | n | n | n |
| 16 | n | n | n | n | n | n |
| 17 | n | n | n | n | n | n |
| 18 | n | n | n | y | n | n |
| 19 | y | n | n | n | n | n |
| 20 | n | n | y | y | n | n |
| 21 | n | n | n | n | n | n |
| 22 | n | n | n | n | n | n |
| 23 | n | n | n | n | n | n |
| 24 | n | n | n | n | n | n |
| 25 | n | n | n | n | n | n |
| Total failure frequency in [%] | 4 + 1 = 5 20% | | 3 + 2 = 5 20% | | 0 + 0 = 0 0% | |

The pouch chambers 1 having a through-flow opening 10 (opening area A3 for 1) around 5%, for 2) around 4% and for around 8%) in relation to the footprint A2 of the film pouch 3) showed a statistically much lower likelihood of failure compared to the detergent products 1 having a closed sealing section in the middle region of the film pouch 3 and also compared to the pouch chambers 1 having a central chamber in the middle.

Experiments showed that these results also apply to other pouch chamber numbers, sizes and geometries. The proportion of the opening area A3 of the through-flow opening 10 on the total footprint A2 of the film pouch 3 should preferably lie in the range between 0.5% to 50%, preferably between 10% to 20%.

LIST OF REFERENCE SIGNS

1 detergent product
2 pouch chamber
3 film pouch
4 sealing section
5 end section
6 end section
7 connecting section
8 connecting section
9 central chamber
10 through-flow opening
11 area bisector

What is claimed is:

1. A detergent product for treating textiles, comprising a film pouch having at least one pouch chamber which is enclosed by at least one water-soluble film and contains a detergent preparation, wherein the film pouch has only one through-flow opening arranged outside of the pouch chamber.

2. The detergent product according to claim 1, wherein the pouch chamber is formed by at least two film layers which are sealed to one another in one or more sealing sections, and in that the through-flow opening is provided in a region of a sealing section between at least two adjacent pouch chambers.

3. The detergent product according to claim 2, wherein the pouch chamber is formed by only two film layers which are sealed to one another in one or more sealing sections, and in that the through-flow opening is provided in a region of a sealing section between at least two adjacent pouch chambers.

4. The detergent product according to claim 1, wherein the film pouch has a footprint located in the sealing plane, and in that the through-flow opening is provided in a middle region of the footprint of the film pouch.

5. The detergent product according to claim 4, wherein the through-flow opening has an opening area, and wherein the opening area of the through-flow opening on the footprint of the film pouch is between 0.5% to 50%.

6. The detergent product according to claim 1, wherein the film pouch has between two to ten pouch chambers.

7. The detergent product according to claim 6, wherein the film pouch has between three and five pouch chambers.

8. The detergent product according to claim 1, wherein more than two pouch chambers are arranged around the through-flow opening.

9. The detergent product according to claim 1, wherein the through-flow opening is oval.

10. The detergent product according to claim 1, wherein an outer contour of the through-flow opening is designed to be complementary, at least in some sections, to an outer contour of at least one adjacent pouch chamber.

11. The detergent product according to claim 1, wherein a sealing section is provided between a pouch chamber and the through-flow opening, and in that the sealing section has a width between 1 mm and 5 mm, and/or in that the sealing section is non-rectilinear.

12. The detergent product according to claim 1, wherein the through-flow opening has an opening area between 10 $mm^2$and 700 $mm^2$.

13. A detergent product for treating textiles, comprising a film pouch having at least one pouch chamber which is enclosed by at least one water-soluble film and contains a detergent preparation, wherein the film pouch has more than 1 and less than 10 through-flow openings arranged outside of the pouch chamber.

14. The detergent product according to claim 13, wherein each of the through-flow openings has an opening area and wherein the opening area of all through-flow openings is between 10 $mm^2$ and 700 $mm^2$.

15. The detergent product according to claim 13, wherein the film pouch has a footprint located in a sealing plane, wherein each of the through-flow openings has an opening area, and wherein the opening area of all through-flow openings on the footprint of the film pouch is between 0.5% to 50%.

* * * * *